United States Patent [19]

Tews

[11] 4,143,859

[45] Mar. 13, 1979

[54] CEMENT FENCE POST

[76] Inventor: Ricky R. Tews, Box 7, Moore, Mont. 59464

[21] Appl. No.: 921,191

[22] Filed: Jul. 3, 1978

[51] Int. Cl.[2] ..... E04H 17/20; E04H 17/10

[52] U.S. Cl. ..... 256/49; 256/19; 52/722

[58] Field of Search ..... 256/48, 49, 50, 51, 256/52, 54, 57, 19; 52/722

[56] References Cited

U.S. PATENT DOCUMENTS

| | | | |
|---|---|---|---|
| 505,367 | 9/1893 | Paldi | 256/50 |
| 1,044,231 | 11/1912 | Obenauf | 256/54 |
| 1,104,626 | 7/1914 | Chambers | 256/49 |
| 1,174,115 | 3/1916 | Bennett | 256/52 |
| 1,676,679 | 7/1928 | Bensinger | 52/722 X |
| 1,879,725 | 9/1932 | Aiton | 256/52 |

*Primary Examiner*—Andrew V. Kundrat
*Attorney, Agent, or Firm*—Daniel Jay Tick

[57] ABSTRACT

A central bar extends along the center of a cement post from the bottom of the post to a point spaced above the top thereof and has a diametric bore formed therethrough in the area of the top end. A support member extends from the post perpendicularly to a length-extending surface thereof and has a free end spaced from the surface and a slot formed therethrough in the area of the free end. An elongated flat fence bar is bent at right angles to itself in the area of a first end thereof to form a top part covering the top of the post. The top part has a hole formed therethrough for accommodating the top end of the central bar. A tongue projecting from the second opposite end of the fence bar fits into the slot through the support member when the fence bar is mounted on the post with the central bar extending through the hole through the top part thereof. The fence bar has a plurality of pairs of bores formed therethrough at equally spaced distances along the length thereof. A cotter pin passes through the bore through the top end of the central bar to releasably secure the fence bar to the fence post. A plurality of fence stays secure a fence wire to the fence bar via the pair of bores of the fence bar.

2 Claims, 4 Drawing Figures

CEMENT FENCE POST

BACKGROUND OF THE INVENTION

The present invention relates to a cement fence post.

Cement fence posts are described in the following United States patents. U.S. Pat. No. 760,111, issued May 17, 1904 to Ewell, 821,535, issued May 22, 1906 to Perkins, U.S. Pat. No. 824,562, issued June 26, 1906 to Miller, U.S. Pat. No. 836,128, issued Nov. 20, 1906 to McElroy, U.S. Pat. No. 842,454, issued Jan. 29, 1907 to Gibler and U.S. Pat. No. 883,005, issued Mar. 24, 1908 to Doddridge.

Objects of the invention are to provide a cement fence post of simple structure, which is inexpensive in manufacture, securely maintains a wire fence in position to a desired extent of tautness or tension, and functions efficiently, effectively and reliably as a fence post of indefinitely long life thereby eliminating the need for periodic replacement, as is the case with wooden fence posts.

BRIEF DESCRIPTION OF THE DRAWINGS

In order that the invention may be readily carried into effect, it will now be described with reference to the accompanying drawings, wherein.

Figure 1:
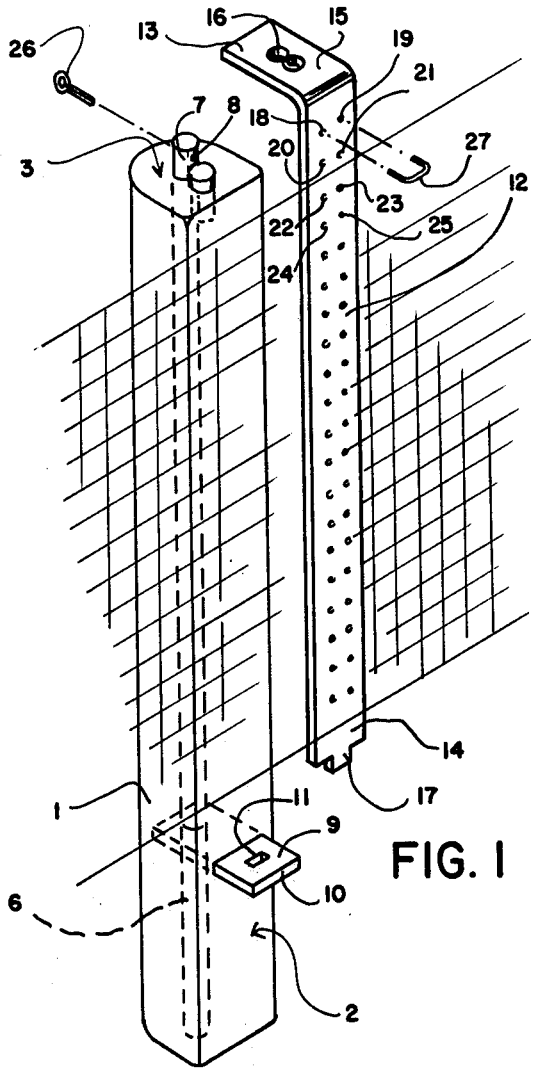
FIG. 1 is a partially exploded perspective view of an embodiment of the cement fence post of the invention.
Figure 2:
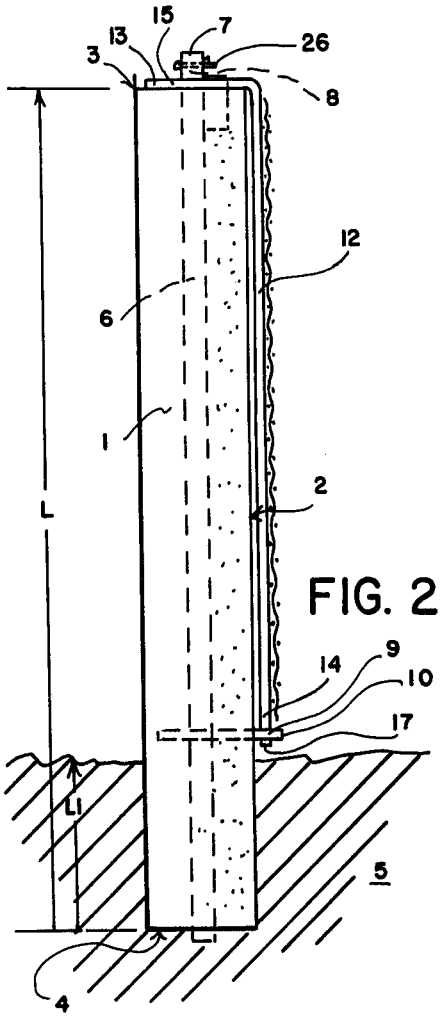
FIG. 2 is a side view of the embodiment of FIG. 1 in assembled condition.

DETAILED DESCRIPTION OF THE INVENTION:

The cement fence post of the invention comprises a cement post 1 (FIGS. 1 and 2) having a predetermined length L (FIG. 2), a length-extending surface 2 (FIGS. 1 and 2), a top 3 (FIGS. 1 and 2) and a spaced opposite bottom 4 (FIG. 2). The post 1 is embedded for part of its length L1 in the ground 5 (FIG. 2).

A central bar 6 longer than the predetermined length L, as shown in FIGS. 1 and 2, extends substantially along the center of the post 1 from the bottom 4 thereof to a point spaced above the top 3 thereof, as shown in FIGS. 1 and 2. The central bar 6 has a top end 7 spaced from the top 3 of the post 1, as shown in FIGS. 1 and 2. The central bar 6 has a substantially diametric bore 8 formed therethrough in the area of its top end 7, as shown in FIGS. 1 and 2.

A support member 9 extends from the post 1 substantially perpendicularly to the surface 2 thereof, as shown in FIGS. 1 and 2. The support member 9 has a free end 10 spaced from the surface 2 of the post 1 and has a slot 11 formed therethrough in the area of the free end (FIG. 1).

An elongated flat fence bar 12 (FIGS. 1, 2 and 4) has spaced opposite first and second ends 13 and 14, respectively, as shown in FIGS. 1 and 2, and is bent at right angles to itself in the area of its first end 13 to form a top part 15 covering the top 3 of the post 1 (FIGS. 1 and 2). The top part 15 of the fence bar 12 has a hole 16 (FIG. 1) formed therethrough for accommodating the top end 7 of the central bar 6 in the manner shown in FIG. 2.

The fence bar 12 has a projecting tongue 17 (FIGS. 1 and 2) at its second end 14 fitting into the slot 11 through the support member 9 when the fence bar is mounted on the post 1 with the central bar 6 extending through the hole 16 through the top part 15 of said fence bar, in the manner shown in FIG. 2. The fence bar 12 has a plurality of pairs of bores 18 and 19, 20 and 21, 22 and 23, 24 and 25, and so on, formed therethrough at equally spaced distance along the length thereof, as shown in FIG. 1.

A cotter pin 26 passes through the bore 8 through the top end 7 of the central bar 6, in the manner shown in FIG. 2, to releasably secure the fence bar to the fence post.

Figure 3:
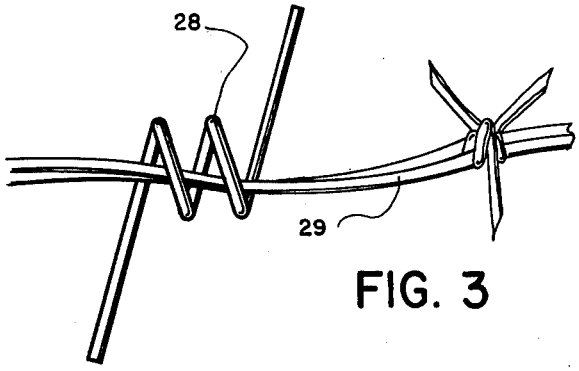
FIG. 3 is a perspective view, on an enlarged scale, of a preferred embodiment of a fence stay of the cement fence post of the invention.
Figure 4:
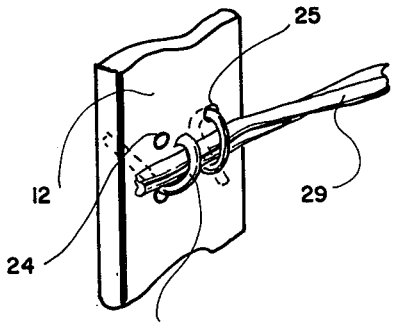
FIG. 4 is a perspective view, on an enlarged scale, of the fence stay of FIG. 3 in use securing a fence wire to the cement fence post of the invention.

A plurality of fence stays 27 (FIG. 1), and so on, secure a wire fence to the fence bar 12 via the pairs of bores 18 and 19, and so on, of said fence bar. A preferred embodiment of a fence stay, as shown in FIGS. 3 and 4, comprises a short length 28 of substantially resilient wire bent in a substantially helical configuration of a few turns.

The wire strands 29 (FIGS. 3 and 4), and so on, are first affixed to the fence bar 12 via the fence stays 28, and so on. The fence bar 12 is then secured to the fence post via the support member 9 and the central bar 6 of said fence post.

While the invention has been described by means of a specific example and in a specific embodiment, I do not wish to be limited thereto, for obvious modifications will occur to those skilled in the art without departing from the spirit and scope of the invention.

I claim:

1. A cement fence post, comprising a cement post having a predetermined length, a length-extending surface, a top and a spaced opposite bottom, said post being embedded for part of its length in the ground;

a central bar longer than the predetermined length extending substantially along the center of the post from the bottom thereof to a point spaced above the top thereof, said central bar having a top end spaced from the top of the post and having a substantially diametric bore formed therethrough in the area of the top end;

a support member extending from the post substantially perpendicularly to the surface thereof, said support member having a free end spaced from said surface and having a slot formed therethrough in the area of said free end;

an elongated flat fence bar having spaced opposite first and second ends, said fence bar being bent at right angles to itself in the area of its first end to form a top part covering the top of the post, said top part having a hole formed therethrough for accommodating the top end of the central bar and having a projecting tongue at its second end fitting into the slot through the support member when said fence bar is mounted on the post with the central bar extending through the hole through the top part thereof, said fence bar having a plurality of pairs of bores formed therethrough at equally spaced distances along the length thereof;

a cotter pin passing through the bore through the top end of the central bar to releasably secure the fence bar to said fence post; and a plurality of fence stays for securing a wire fence to the fence bar via the pairs of bores of said fence bar.

2. A cement fence post as claimed in claim 1, wherein each of the fence stays comprises a short length of substantially resilient wire bent in a substantially helical configuration of a few turns.

* * * * *